United States Patent [19]

Bowler, Jr.

[11] Patent Number: 4,571,054

[45] Date of Patent: Feb. 18, 1986

[54] POST-FUSER COPY SHEET DECURLER

[75] Inventor: Edward F. Bowler, Jr., Webster, N.Y.

[73] Assignee: Xerox Corporation, Stamford, Conn.

[21] Appl. No.: 500,121

[22] Filed: Jun. 1, 1983

[51] Int. Cl.[4] ..... G03G 15/00

[52] U.S. Cl. ..... 355/3 SH; 355/3 FU

[58] Field of Search ..... 355/3 FU, 3 SH; 219/216, 388, 469, 470, 471; 271/DIG. 1, 307, 311, 312, DIG. 2, 900; 432/60

[56] References Cited

U.S. PATENT DOCUMENTS 4,028,050 6/1977 Bar-on ..... 271/DIG. 2

4,265,990 5/1981 Stolka et al. ..... 430/59

4,281,623 8/1981 Kato et al. ..... 355/3 FU 4,375,327 3/1983 Matsumoto et al. ..... 355/3 FU

*Primary Examiner*—A. T. Grimley

*Assistant Examiner*—David Warren

[57] ABSTRACT

This invention relates to the art of xerography and analogous graphic arts and more particularly to a copy sheet decurling mechanism employed in conjunction with a heat and pressure fuser for reducing or eliminating the curl induced into the copy sheets by the pressure roll of the fuser. To this end, means are provided for reverse (i.e. direction opposite to bending caused by the pressure roll) bending of the copy sheets while they are in a plastic state, that is while the sheets are still at an elevated temperature.

4 Claims, 2 Drawing Figures

POST-FUSER COPY SHEET DECURLER

Figure 1:
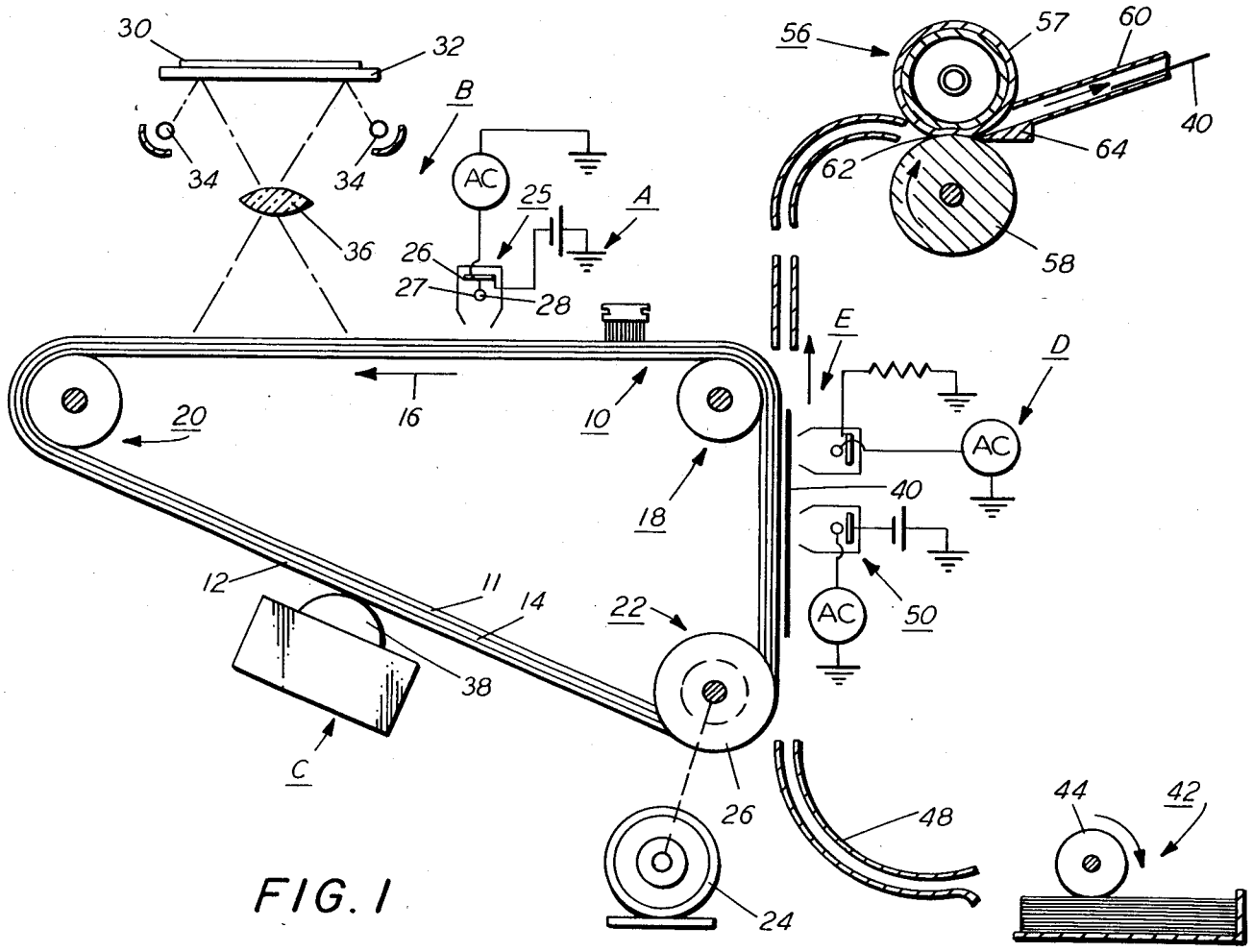

This invention relates to fuser apparatus for heat and pressure fusing toner images to sheets of support material such as plain paper. More particularly, the invention relates to apparatus and a method for reducing sheet curl in induced by roll fusers of the type employed in xerographic or analogous-type machines.

In the art of xerography, a photoconductor P/C generally comprising a photoconductive insulating material adhered to a conductive backing is charged uniformly. Then the P/C is exposed to a light image of an original document to be reproduced. The latent electrostatic images, thus formed, are rendered visible by applying any one of numerous pigmented resins specifically designed for this purpose. In the case of a reusable P/C, the pigmented resin, more commonly referred to as toner which forms the visible images is transferred to plain paper. After transfer, the toner images are made to adhere to the copy medium usually through the application of heat and pressure by means of a roll fuser.

One of the more recent advances in the art of contact fusing of toner images is the nip forming roll fuser (i.e. a roll fuser wherein the nip between the rolls is formed by deforming the softer fuser roll) wherein a heated roll is provided with an outer deformable coating of silicone rubber, for example. A harder, usually non-heated, pressure roll is pressure engaged with the softer fuser roll to create a nip therebetween. Copy sheets having toner images electrostatically adhered thereto are passed through the nip with the images contacting the heated roll.

The requisite roll size is a function of a number of variables such as the copy making speed of the machine. Thus, the faster machines utilize relatively larger rolls whereas the slower machines use small (i.e. 1½-2 inch diameter) diameter rolls. I found that with the smaller rolls, the copy sheets release or fall away from the nip forming fuser roll thereby coming to rest on the pressure roll mounted beneath the fuser roll. This results in the copy sheet taking the general shape of the pressure roll. One such fuser arrangement was found to produce between ½ to 1½ inch flat plate curl which bends away from the image. The flat plate curl method measures the height of the copy corners above a flat surface. The copies in some cases were forming scrolls and were causing post fuser handling problems, in particular, with regard to the stacking of the copies in the output tray.

As will be discussed hereinbelow in greater detail, I have provided a post-fuser decurling device for minimizing the problem described hereinabove.

Functionally, my invention is designed to intentionally cause deformation or bending of the copy sheets. This intentional deformation acts in the reverse direction to that of the deformation caused by the copy sheets conforming to the general shape of the pressure roll. I have found that by applying suitable forces to the copy sheets in the manner described above while the copy sheets are still in the plastic (i.e. paper temperature is sufficiently elevated so that the paper is readily deformable) state, sheet curling can be satisfactorily minimized.

To this end, there are provided one or more stripper members preferably in the form of one or more fingers which are mounted so that the tips thereof are in contact with the pressure roll and spaced approximately 1/8 inch from the nip.

The angle at which the paper is stripped is chosen so that the lead edge of the sheet and subsequent areas thereof are bent in a direction that is reverse to the direction that the paper goes through while contacting the pressure roll. To this end, the fingers are oriented at an attack angle of approximately 35 degrees. A sheet guide is oriented at approximately the same angle as the stripper fingers and receives the copy sheets when they are still in a plastic state. Also, the guide is close enough to the ends of the stripping fingers so that the copy sheet is precluded from drooping or sagging over the ends of the stripper fingers. Therefore, the sheet guide maintains the reverse bending that is initiated by the stripper fingers.

Other aspects of the present disclosure will become apparent as the following description proceeds with reference to the drawings.

Figure 2:
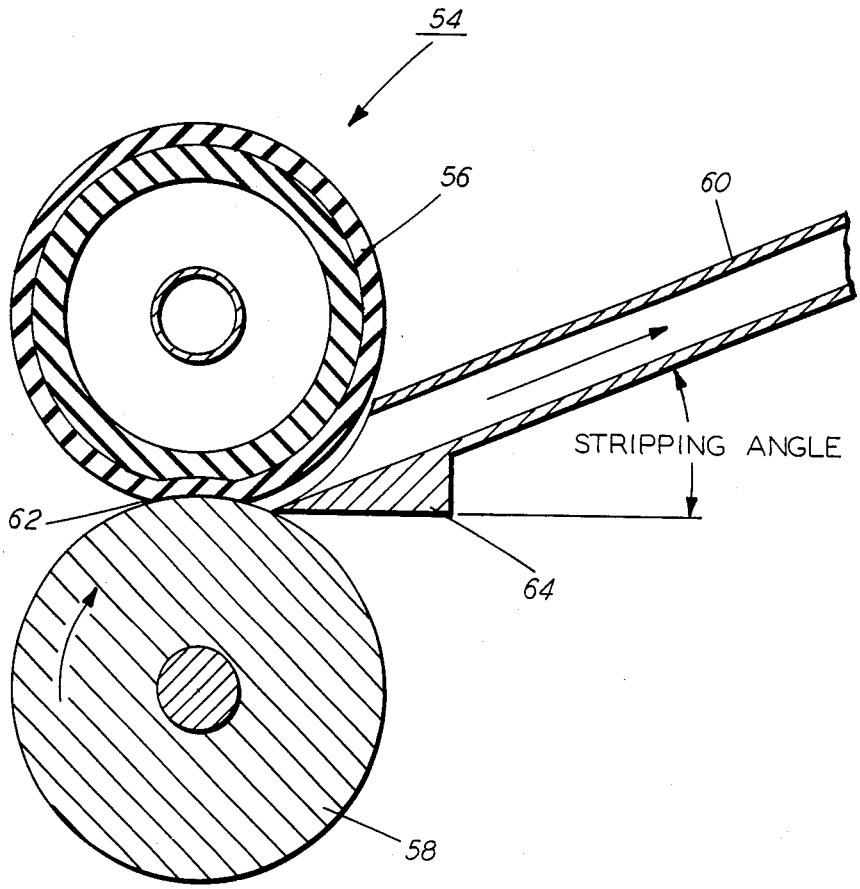

FIG. 1 is a schematic elevational view depicting an electrophotograhpic printing machine incorporating the present invention; and FIG. 2 is a schematic illustration of a heat and pressure fuser roll and a post-fuser decurling mechanism representing the present invention.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 whch consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A P/C of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance successive portions thereof sequentially through the various processing stations disposed about the path of movement thereof.

Belt 20 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges layer 12 of belt 10 to a relatively high, substantially uniform negative potential. A suitable corona generating device for negatively charging the P/C belt 10 comprises a conductive shield 26 and corona wire 27 the latter of which is coated with an electrically insulating layer 28 having a thickness which precludes a net d.c. corona current when an a.c. voltage is applied to the corona wire when the shield and P/C surface are at the same potential.

Next, the charged portion of the P/C belt is advanced through exposure station B. At exposure station B, an original document 30 is positioned face down upon a transparent platen 32. The light rays reflected from original document 30 form images which are transmitted through lens 36 the light images are projected onto the charged portion of the P/C belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the P/C belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser asembly 54 includes a heated fuser roller 56 adapted to be pressure engaged with a back-up roller 58 with the toner powder images contacting fuser roller 56. In this manner, the toner powder image is permanently affixed to sheet 40. The fuser roll 56 comprises a relatively thick (i.e., 10–60 mils) coating or layer 57 of silicone rubber which is deformable by the harder pressure roller 58. After fusing, chute 60 guides the advancing sheet 40 to catch tray 62 for removal from the printing machine by the operator.

The fuser assembly 54, as shown in FIG. 2 of the drawings, comprises the centrally heated roll 56 which is supported above the pressure roll 58. To fuse the toner images carried by the copy sheets the sheets are moved through the nip 62 formed between the two rolls such that the images contact the heated roll. A plurality of stripper fingers 64 (only one of which is shown) are provided to remove the copy sheets from the pressure roll. The fingers are preferably fabricated from a resin material such as Teflon (a trademark of E. I. duPont). The tips of the fingers touch the surface of the pressure roll at approximately ⅛ of an inch from the nip 62 and the fingers are disposed at an angle of 35 degrees relative to a plane tangent to the pressure roll surface in the area of the nip. The purpose of such positioning of the fingers is so that they can effect a reverse bending of the copy sheets, such bending being in the direction opposite to that caused by the pressure roll. This reverse bending has the effect of straightening out the copy sheets to thereby substantially reduce or eliminate the objectionable curl.

A chute or guide 60 is also provided which maintains the reverse bend induced into the copy sheet by the stripper fingers. For this purpose, the chute or guide is also supported at approximately 35 degrees with respect to the same reference point as the stripper fingers.

As will be appreciated, other angular orientations of the stripper fingers and chute may be used, the orientations being a function of the roll size with which they are to be used. The important aspect of the angle and the positioning of the finger tips relative to the nip is that the fingers effect the degree of bending necessary to satisfactorily reduce the curl caused by the pressure roll.

It can now be appreciated that there has been disclosed a copy sheet decurling mechanism which substantially reduces or eliminates the undesirable curl induced into the copy sheets by a relatively small diameter pressure forming the lower roll of a heat and pressure fuser roll arrangement.

I claim:

1. In a xerographic reproducing apparatus including a heat and pressure roll fuser for fixing toner images to copy sheets, the improvement comprising:

post-decurling means for removing curl induced into said copy sheets by a pressure roll forming a part of said roll fuser;

said post-decurling means comprising means for separating copy sheets from said pressure roll, said separating means being effective to bend said copy sheets in the direction opposite to the direction of bend induced by said pressure roll;

means associated with said separating means for receiving said copy sheets and for maintaining said sheets in the condition in which they leave said separating means; and said separating means comprising a plurality of stripper fingers contacting said pressure roll and said maintaining means comprising a guide positioned adjacent to said stripper fingers and in line therewith, each of said stripper fingers being oriented at an acute angle of approximately 35 degrees with respect to a plane tangent to said pressure roll, said plane coinciding with the plane of said copy sheets prior to the curl being induced therein by said pressure roll, said guide being disposed at the same angle as said stripper fingers, the plane occupied by said stripper fingers and said guide being such that said copy sheets are caused to travel in a generally upward direction.

2. Apparatus according to claim 1 wherein the tips of said stripper fingers are spaced approximately ⅛ inch from nip found between the rolls forming said fuser.

3. Apparatus according to claim 2 wherein said stripper fingers and said guide are close enough to said roll fuser that said copy sheets are in a plastic state when they reach said fingers and said guide.

4. Apparatus according to claim 3 wherein said guide is close enough to said stripper fingers so that drooping of said copy sheets over the ends of said stripper fingers is precluded.

* * * * *